US005797532A

United States Patent [19]

Flagg

[11] Patent Number: 5,797,532

[45] Date of Patent: Aug. 25, 1998

[54] WEB EDGE CONTROL SYSTEM

[75] Inventor: Richard Edward Flagg, Wareham, Mass.

[73] Assignee: Double E Company, Inc., Westbridgewater, Mass.

[21] Appl. No.: 839,411

[22] Filed: Apr. 14, 1997

Related U.S. Application Data

[63] Continuation of Ser. No. 281,211, Jul. 27, 1994, abandoned.

[51] Int. Cl.[6] ..... B65H 20/24

[52] U.S. Cl. ..... 226/119; 226/198; 242/417.3; 242/548

[58] Field of Search ..... 226/44, 25, 113, 226/114, 118, 119, 195, 198; 242/534.1, 417.3, 548

[56] References Cited

U.S. PATENT DOCUMENTS

| | | | |
|---|---|---|---|
| 1,962,029 | 6/1934 | Murphy et al. | 242/418.1 |
| 2,348,162 | 5/1944 | Warner | 226/195 X |
| 3,013,707 | 12/1961 | Beachler | 242/417.3 X |
| 3,130,936 | 4/1964 | Rochman | 242/417.3 X |
| 3,499,306 | 3/1970 | Pearson | 226/195 X |
| 3,734,368 | 5/1973 | Kudelski | 226/195 X |
| 3,870,214 | 3/1975 | Schmid | 226/34 |
| 3,875,682 | 4/1975 | Justus et al. | 34/118 |
| 3,905,533 | 9/1975 | Corse | 226/44 |

FOREIGN PATENT DOCUMENTS

| | | | |
|---|---|---|---|
| 109247 | 4/1955 | France | 242/417.3 |
| 1288148 | 12/1962 | France | 226/195 |
| 203093 | 3/1966 | Sweden | 242/417.3 |
| 872419 | 10/1981 | U.S.S.R. | 242/417.3 |
| 2240770 | 8/1991 | United Kingdom | 242/417.3 |

*Primary Examiner*—Daniel P. Stodola
*Assistant Examiner*—William A. Rivera
*Attorney, Agent, or Firm*—Hale and Dorr LLP

[57] ABSTRACT

A pair of freely rotatable rolls bear against the opposite edges of a moving web. Each roll is mounted with its axis generally coaxial with that of the other roll, parallel to the adjacent rollers of the web transport systems and perpendicular to the direction of web movement. A support arm for each roll is pivotally connected to a fixed support, with the pivotal axis generally parallel to that of the roll, so that the weight of the roll pivots the arms towards the vertical and causes the roll to bear against the upper surface of the web. A constant bias force may be applied to the pivotal support arm to decrease (or in some circumstances to increase) the force with which gravity causes the roll to bear against the web.

10 Claims, 3 Drawing Sheets

WEB EDGE CONTROL SYSTEM

This application is a continuation of application Ser. No. 08/281,211, filed Jul. 27, 1994, now abandoned.

FIELD OF THE INVENTION

This invention relates to web control and, more particularly, to controlling the edges of a web.

BACKGROUND OF THE INVENTION

In web transport operations, such as paper converting, it is important to control the tension across the width, and to smooth out the web so as to prevent warp and curl (particularly along the edges), of the running web. There have in the past been a number of systems proposed to condition the web and prevent baggy edges, however most are relatively expensive and complex. For example, U.S. Pat. Nos. 3,499,306, 4,303,189, 3,838,487, and 4,369,905 disclose systems which sense the edges of a moving web and apply force to the web edges in response to what is sensed. The system of U.S. Pat. No. 3,875,682 controls fluttering at the edges of a web using fixed rollers which engage the edges and are driven at a speed approximately 75% of the web speed. As will be recognized, the systems of all aforementioned patents require active drives and considerable electronic or other control.

Their remains a need for a web edge control system that can be installed on either new or existing web transport systems, and which does not require expensive and often complex air, hydraulic, electrical or sensor connections, or roll drives.

SUMMARY OF THE INVENTION

The present invention features a pair of freely rotatable edge control rolls mounted adjacent opposite edges of the moving web with the axes of the rolls generally parallel to the adjacent rollers of the web transport system and perpendicular to the direction of web movement. The two edge control rolls are rotatable and moveable completely independently of each other; and each engages the upper surface of the moving web from the respective web edge to a point adjacent the web centerline. Each web edge control roll is mounted, in axial alignment with the other roll, at an end of a respective support arm. The other end of each support arm is attached to a fixed support so that the arm will pivot freely about an axis parallel to that of the respective roll. Each arm is biased, e.g., by gravity or springs, to control the force with which its roll bears against the web. In most embodiments, the bias is in a direction tending to pivot the arm towards the horizontal, i.e., to reduce the force against the web; in embodiments in which the portion of the web engaging the roll is near the vertical, the web bias may be applied in a direction tending to force the arm towards the vertical, i.e., to increase the force with which the roll bears against the web. In some embodiments, the lengths of the support arms are adjustable, as is the bias force.

Other objects, features and advantages will appear from the following discussion of embodiments of the invention, taken together with the accompanying drawings in which.

DESCRIPTION OF THE EMBODIMENT

Figure 1:
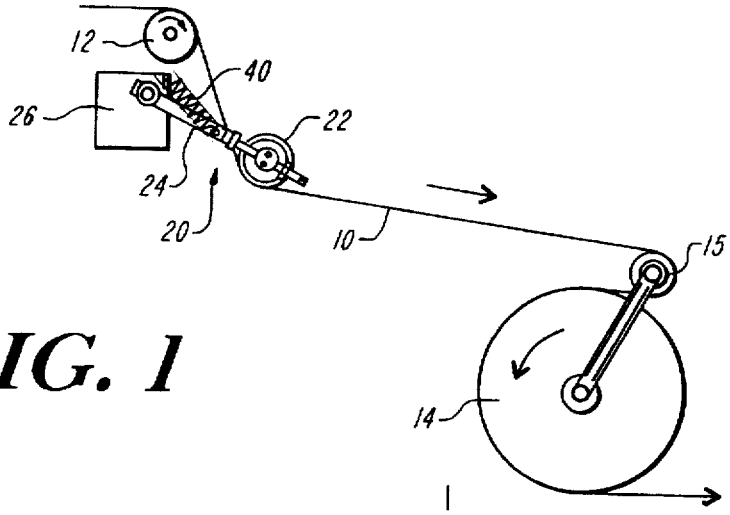
FIG. 1 is a schematic of a portion of a web transport system including the web edge controller of the present invention.

Referring to FIG. 1, a web 10, e.g., corrugated cardboard, paper sheeting, plastic sheeting, or the like, from a supply roll (not shown) passes over a guide roll 12 to, and about 180° around, a preheater roll 14. A conventional wrap roller 15 insures that the web will wrap around the preheater. Web transport systems including such guides and preheaters are well-known in the art. The webs in such web transport systems move at high speed, and its is important that the tension in the web be substantially constant across the entire width of the web, which typically may be several feet wide. In FIG. 1, the directions of movement of the web 10, and of rotation of rolls 12 and 14, are indicated by arrows.

FIG. 1 also shows a web edge controller, generally designated 20, mounted between the guide roll 12 and the preheater roll 14. As shown in more detail in FIGS. 2 and 3, web edge controller 20 comprises a cylindrical edge control roll 22 that engages and presses down on the upper surface of the running web 10. Edge control roll 22 is mounted with its axis 23 generally parallel to the axes of guide roll 12 and preheater roll 14, i.e., with axis 23 generally parallel to the width of the web 10 and perpendicular to the direction of movement of the web 10, and is freely rotatable around its axis.

Figure 3:
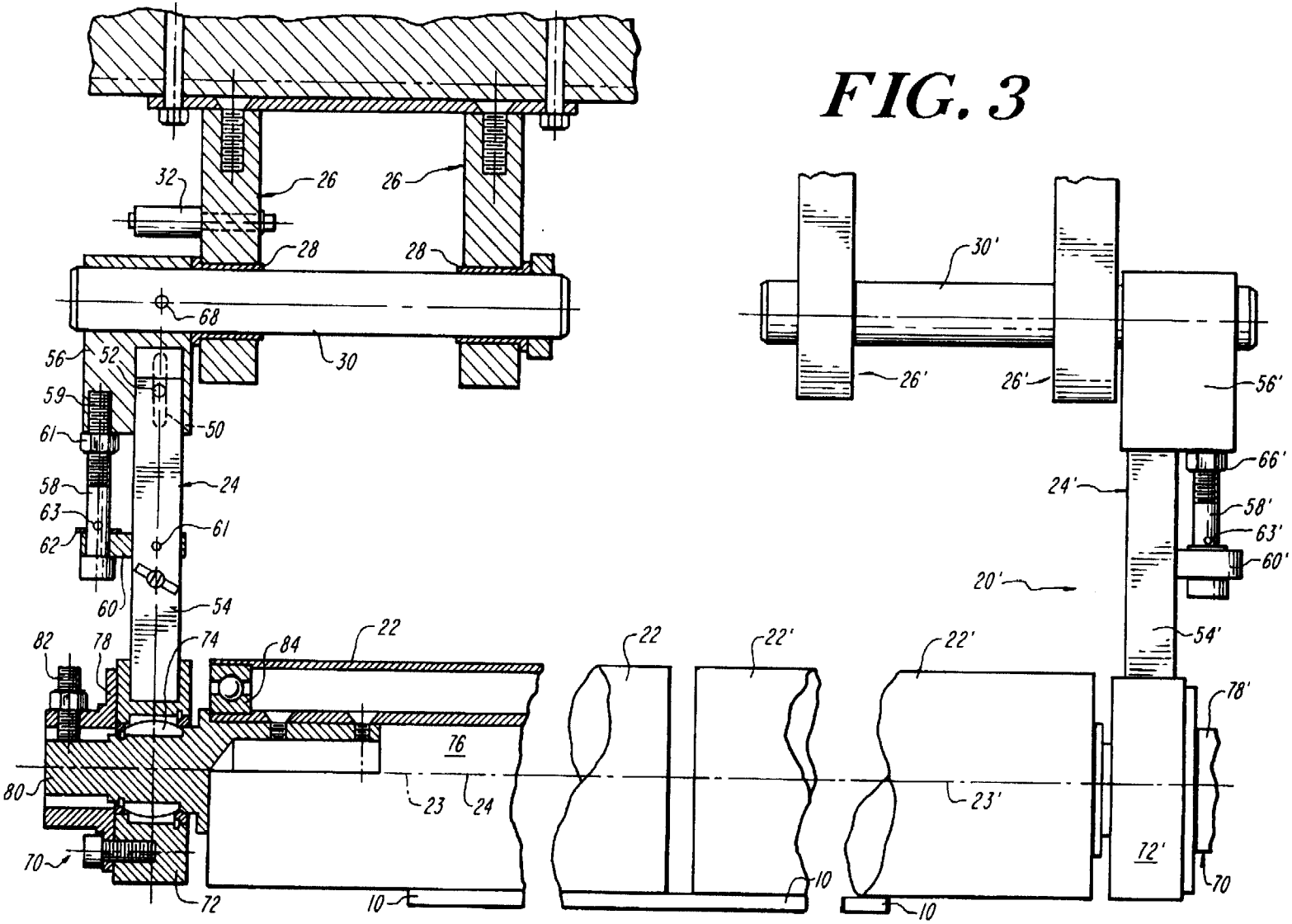
FIG. 3 is a front view of the web controller of FIGS. 1 and 2.

The overall length of roll 22 is equal to approximately one-half the width of the maximum width web with which it will be used. In practice, and as shown in FIG. 3, a pair of web edge controllers 20, 20' are mounted on opposite sides of the web 10, with the rolls 22, 22' of the two web edge controllers generally coaxial with each other. The two edge controllers 20, 20' are completely independent of each other, and are positioned such that the adjacent ends of their respective rolls 22, 22' are spaced slightly from each other (e.g., about ⅛ in. apart) on opposite sides of the centerline 11 of the web 10.

The outer end of each roll 22, 22' is cantilever mounted, adjacent a respective edge of web 10, on a support arm 24, 24' which in turn is attached to a fixed support 26, 26'. As shown most clearly in FIG. 3, support 26 includes a pair of bearings 28 which support a shaft 30 to which support arm 24 is connected. The axis of shaft 30 is parallel to that of roll 22, and the shaft is free to rotate within bearings 28. Thus, as will be recognized, support 24 normally is freely pivotal about the axis of shaft 30, and roll 22 is free to move generally up and down in contact with web 10. A shaft lock 32 is provided to lock shaft 30, and thus support arm 24, in position when desired, e.g., when a web is being replaced. The construction of the support for roll 22' is essentially the same.

Figure 2:
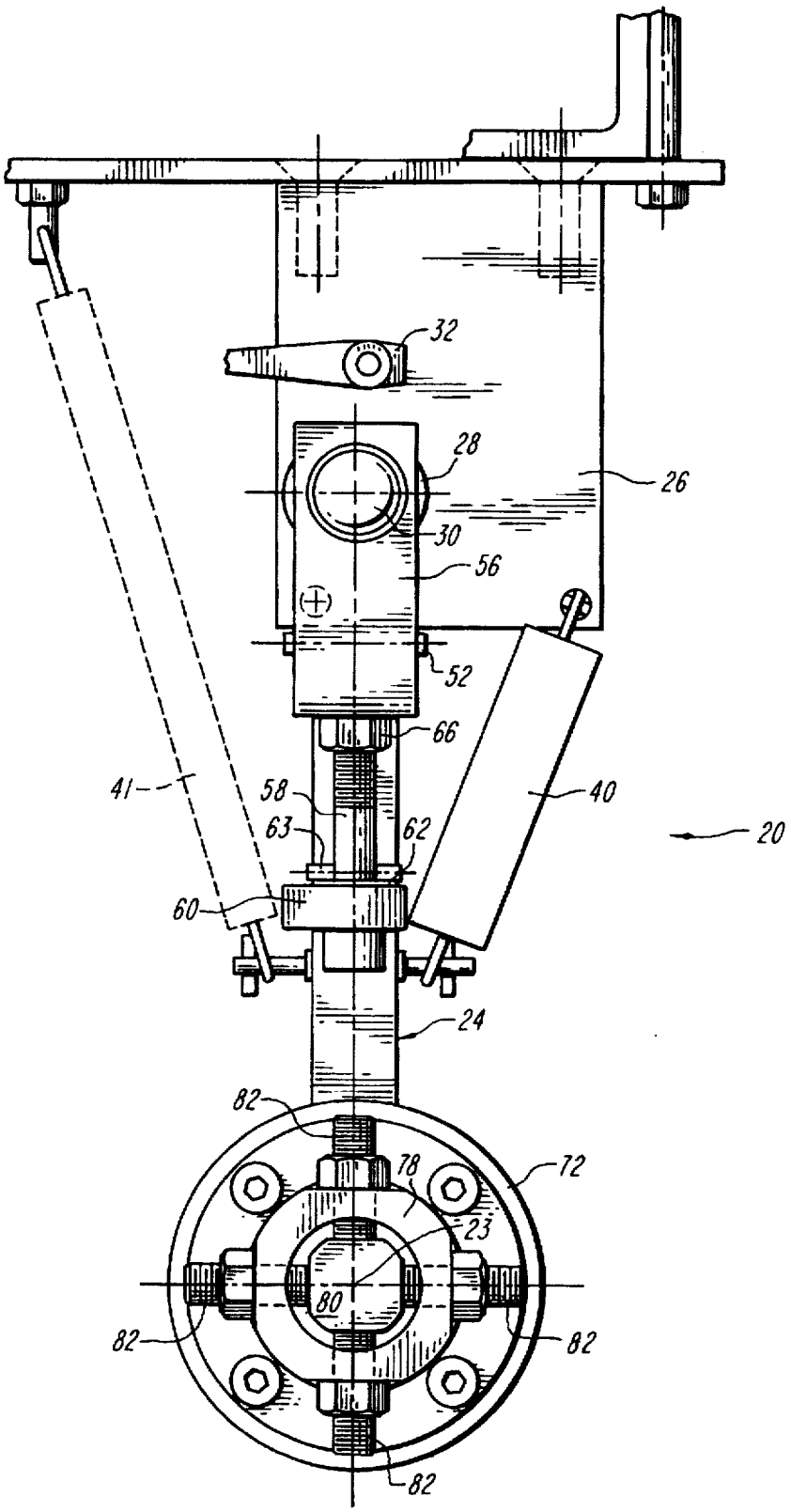
FIG. 2 is a side view, partially cut-away and in section, of the web edge controller shown in FIG. 1.

As will be most evident in FIG. 1, the weight of a roll 22, 22' (and to lesser extent that of the associated support arm 24, 24') tends to pivot arms 24, 24' down (clockwise as viewed in FIG. 1), and to force the rolls against the top surface of the web 10. The downward force of the rolls against the web, caused solely by gravity, "tames" the web edges. It has been found that only a relatively small force is required to "tame" the web edge, i.e., to control fluttering or other undesired movement of the web edge. Typically, the weight of a roll and the angle of the web surface relative to the horizontal are such as to result in a force considerably greater than has been found to be necessary or desirable. Thus, and as shown in FIGS. 1 and 2, helical tension springs are provided to bias the support arms in the opposite direction (i.e., towards the horizontal, counterclockwise as shown in FIGS. 1 and 2) and thus reduce (but not to eliminate) the force with which the rolls 22, 22' bears against the web. As shown in FIGS. 1 and 2, one end of the spring 40 of control 20 is connected to fixed support 26, and the other end of the spring is connected to the support arm 24, normally at a point considerably closer to roll 22 then to shaft 30.

It should be recognized, however, that there will be circumstances in which the weight of the roll alone will result in too little, rather than too much, force being applied to the web. Typically, this will occur when the path along which the web travels, and the particular location at which the web edge controller is mounted, are such that support arm is close to the vertical when the web edge control roll is in contact with the web. In these circumstances, it may be desirable instead to bias the roll towards the web (i.e., towards the vertical rather than away from the web). As indicated in FIG. 2, this may be accomplished by eliminating spring 40, and substituting, therefore, a tension spring 41 as shown in phantom in FIG. 2, on the other side of the support arm 24.

Depending on the particular circumstances in which web edge controller 20 is used it may also be desirable to change the length of support arm 24. As shown in FIGS. 2 and 3, the adjustability is provided by a slot 50 and pin 52 arrangement. The cylindrical central position 54 of support arm 24 fits in a recess in a pivotal end support portion 56 so that central portion can slide back-and-forth in the recess in a direction along the longitudinal axis of the support arm. To control the overall extent of movement, and to insure that the central portion 54 cannot inadvertently fall out of pivotal end support portion 56, slot 50 is provided in central portion 54 and pin 52, the ends of which are fixed in pivotal end support 56, pass through the slot. Central portion 54 may be fixed relative to pivotal end support portion 56 anywhere within the permitted range of movement, thus fixing the overall length of the support arm 24, by bolt 58 which extends from a flange 60 held by pin 61 on central portion 54 into a threaded recess 59 in support portion 56. A pin 63 and washer 64 prevent bolt 62 from falling out of flange 60, and a lock nut 66 locks the bolt in threaded recess 59.

As will be evident from the drawings, pivotal end support portion 56 receives, and is fixed by pin 68 to, shaft 30.

FIG. 3 also most clearly shows the roll end support portion 70 of support arm 24 that supports roller 22. Roll and support portion 70 includes a circular block 72 welded to the end of support arm central portion 54 and in which is fitted a spherical bearing 74 through which passes the end of the generally cylindrical shaft 76 on which roll 22 rotates. The end 80 of shaft 76 is cut square and is held by an end cap 78 bolted to the outside of block 72. Precise adjustments to the axial alignment of roll 22 are made by four adjusting bolts 82 on end cap 78. The bolts are spaced at 90 intervals, and the inner end of each bolt bears against one of the flat faces of the square-cut end 80 of shaft 76.

Roll 22 itself is mounted for free rotation on shaft 76 by ball bearings 84.

Figure 4:
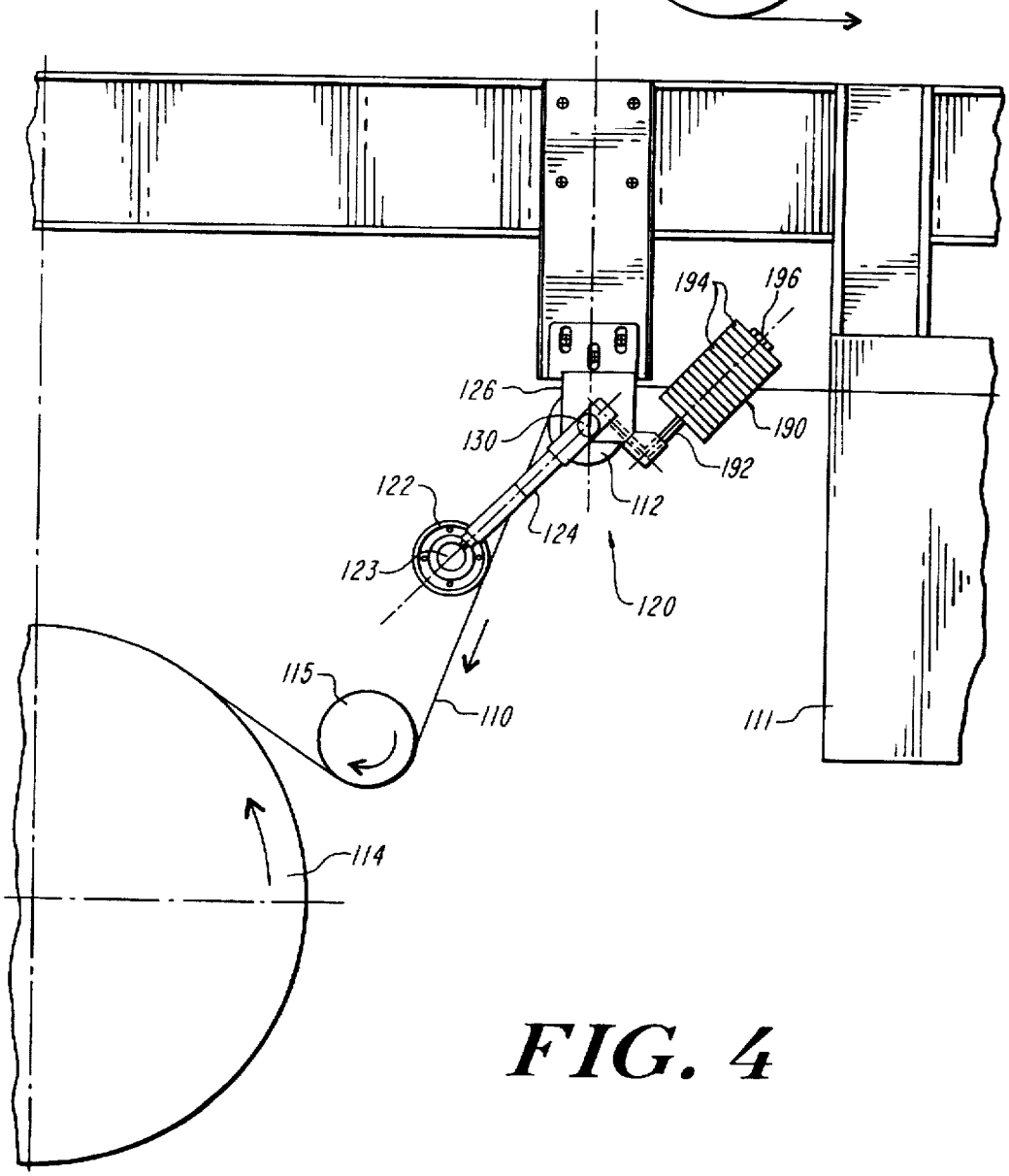
FIG. 4 is a schematic of a portion of another web transport system, including another embodiment of the web edge controller of the present invention.

Reference is now made to FIG. 4 which illustrates a web transport system including a modified web edge controller 120 embodying the invention. In the FIG. 4 system, the web 110 travels from splicer 111, over guide roll 112, and then around wrap roller 115 to preheat roller 114. Web edge controller 120 is positioned so that its roll 122 engages, and presses down on, the upper surface of web 110 between guide roller 112 and wrap roller 115. Similar to the system 20 of FIGS. 1–3, the roll 122 of web edge controller 120 is freely rotatable about its axis, and is cantilever mounted on a support arm 124 which itself is free to pivot about an axis parallel to that of roll 122 (and also parallel to the axes of rolls 112, 114 and 115 and perpendicular to the direction of web movement.

As shown in FIG. 4, the weight of roll 122 tends to rotate arm 124 counterclockwise. To reduce the force (which as in the system of FIGS. 1–3 results solely from gravity) with which the roll 122 presses against the web, a counter-balance, generally designated 190, is attached to support arm 124, on the side of shaft 130 (about which arm 124 pivots) opposite roll 122. As will be evident, counter-balance 190 tends to rotate arm 124 clockwise, i.e., opposite to the rotational force resulting from the weight of roll 122. The counter-balance 190 includes a rod 192, attached to arm 124 so that its longitudinal axis is offset from but substantially parallel to that of arm 124. A plurality (fourteen are shown) of disc-weights 194 are slipped over rod 192 and held on the rod by nut 196. As will be evident, the amount of clockwise bias force produced by counter-balance 190, and hence the force with which roll 122 bears against web 110, may be controlled simply by varying the number of weights 194 used.

The precise weight with which the roll presses against the web is not critical, and will vary with, among other things, the width, speed and type of web. In both this embodiment, and that of FIGS. 1–3, the system and parameters are simply adjusted until no undesirable "flopping" of the web edges is observed.

In typical operation, the web edge controller of the present invention is placed between the first idler roll and conditioning roll to control the web as the rolled material is unwound; it may also be placed anywhere else in the line, typically before a processing roll. No matter where placed, it smooths and flattens out the web, causing it to run smoothly even at higher web speeds. Because each web edge controller operates independently, it conditions (or "tames") only the portions of the web that are in need of conditioning; and, as has been shown, the independent, cantilever mounting automatically adjusts to various warp angles and other conditions, without the need for hydraulic, pneumatic or electrical power and without the need for any sensor input.

Other embodiments will be within the scope of the following claims.

What is claimed is:

1. A system for controlling the opposite edges of a web moving between a pair of spaced-apart, generally parallel, rollers in a direction generally parallel to the web edges and perpendicular to the axes of the rollers, said system comprising:

a pair of web edge controllers each of which is mounted adjacent a respective one of said opposite edges of said web, each of said web edge controllers including (a) a cylindrical web edge control roll freely rotatable about the central axis thereof, and (b) a longitudinally-extending support arm having a first portion thereof attached to a fixed support and, longitudinally spaced therefrom, a second portion thereof attached to said control roll, said first portion of said support arm of each of said web edge controllers being pivotally connected to said fixed support such that said arm is freely pivotal relative to said fixed support about an axis generally parallel to the axes of said rollers, said web edge control roll of each of said web edge controllers being attached to said second portion of said support arm thereof with the central axis of said roll generally parallel to the axes of said rollers, said web edge control roll of each of said web edge controllers being arranged to engage the upper surface of said web in a region including a respective one of said edges of said web and extending inwardly of said web from said respective one edge, said pivotal connection between said first portion of said support arm and said fixed support permitting movement of the said web control roll attached thereto towards and away from the upper surface of said web and being such that gravity causes said support arm of said web edge controller to pivot towards the vertical and to cause said roll of said web controller to bear downwardly against and engage said upper surface of said web, the central axis of said web edge control roll of one of said web edge controllers being generally coaxially aligned with the central axis of the said roll of the other of said systems, the said roll of each of said web edge controllers being movable towards and away from, and to be against and engage, said web independently of the said roll of the other of said web edge controllers, and the roll of each of said web edge controllers bearing against a respective portion of said web with a relatively small force that is less than the weight of the said roll.

2. The systems of claim 1 wherein gravity provides substantially the only force causing said control rolls to bear downwardly on said surface.

3. The system of claim 1 wherein each of said web edge controllers engages a generally horizontal portion of said web and includes a bias force applier arranged to apply a substantially constant bias force tending to cause said arm of said web edge controller to pivot in a direction opposite to the direction that the weight of said roll of said web edge controller tends to cause said arm to pivot, said bias force being such as to reduce but not eliminate the force with which said roll of said web edge controller bears against the generally horizontal portion of the web so that said force is less than the weight of said roll.

4. The system of claim 3 wherein each said bias force applier comprises a spring having an end portion thereof attached to said arm and another end portion thereof attached to said fixed support.

5. The system of claim 3 wherein each said bias force applier comprises a counterweight attached to a portion of said arm that is on the side of a vertical plane including the axis on which said arm pivots opposite the side of said plane on which said roll is located.

6. The system of claim 5 wherein each said counterweight includes a plurality of weights, a selected number of which may be disconnected from said portion of said arm.

7. The system of claim 1 wherein each of said web edge controllers engages a generally vertical portion of said web and includes a bias force applier arranged to apply a substantially constant force tending to cause said arm of said web edge controller to pivot in the same direction that the weight of said roll of said web edge controller tends to cause said arm to pivot thereby to increase the force with which said roll of said each web controller bears against the generally vertical portion of the web so that said force is less than the weight of said roll.

8. The system of claim 1 wherein the length of the portion of said support arm of each of said web controllers between the axis about which said support arm pivots and the axis of said roll of said each web controller may be adjusted to vary the distance between said axis about which said support arm pivots and said axis of said roll.

9. The system of claim 1 wherein the connection between said roll and said support arm of each of said web controllers is such that the angle at which the axis of said web edge control roll of said each web controller is disposed relative to said support arm of said each web controller may be varied and fixed in a precise desired orientation relative to said support arm.

10. The web transport system of claim 1 wherein the said roll of each of said web edge control systems engages a portion of said web extending from the respective said edge of said web to substantially the transverse center of the said web.

* * * * *